United States Patent [19]

Bolton et al.

[11] Patent Number: 4,811,776

[45] Date of Patent: Mar. 14, 1989

[54] APPARATUS AND METHOD FOR CENTERING LOGS

[76] Inventors: William E. Bolton, 2930 N.W. Skyline Dr.; John C. Holbert, 342 N.E. Plymouth Cir., both of Corvallis, Oreg. 97330

[21] Appl. No.: 150,937

[22] Filed: Feb. 1, 1988

[51] Int. Cl.[4] ..... B27B 1/00; B27L 5/02

[52] U.S. Cl. ..... 144/357; 144/209 A; 144/365; 33/367; 356/372; 356/385

[58] Field of Search ..... 364/474, 560, 563, 564; 356/372, 385; 83/367; 144/209 A, 356, 357, 365

[56] References Cited

U.S. PATENT DOCUMENTS 4,246,940 1/1981 Edwards et al. ..... 144/209 A
4,384,601 5/1983 Richert ..... 144/209 A
4,412,297 10/1983 Halgrimson et al. ..... 144/209 A
4,737,031 4/1988 Mahlberg et al. ..... 144/209 A

*Primary Examiner*—W. Donald Bray
*Attorney, Agent, or Firm*—Robert L. Harrington

[57] ABSTRACT

Centering a log by determining the location of a selected axis through the log relative to a fixed replicate axis. The log is pinned and each end is provided with double pivots. Pivoting the log about one pivotal axis spaced from the replicate axis determines a pathway around that axis. Pivoting the log about the other pivotal axis sweeps the log end and, accordingly, the selected axis across the determined pathway. The selected axis is positioned on the pathway by pivoting the log about said other axis and it is positioned at the replicate axis by pivoting the log about the first pivotal axis.

14 Claims, 4 Drawing Sheets

FIG. 1
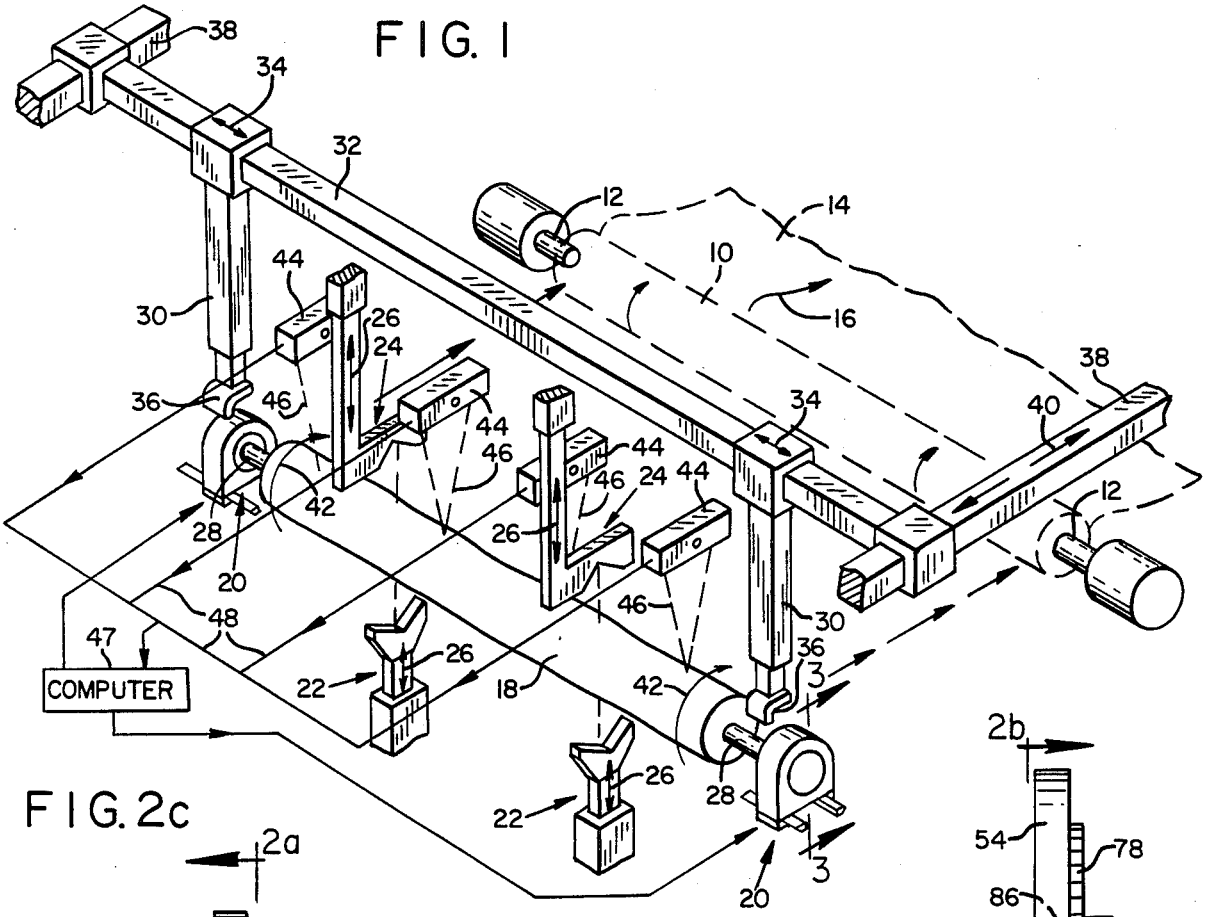
FIG. 2c
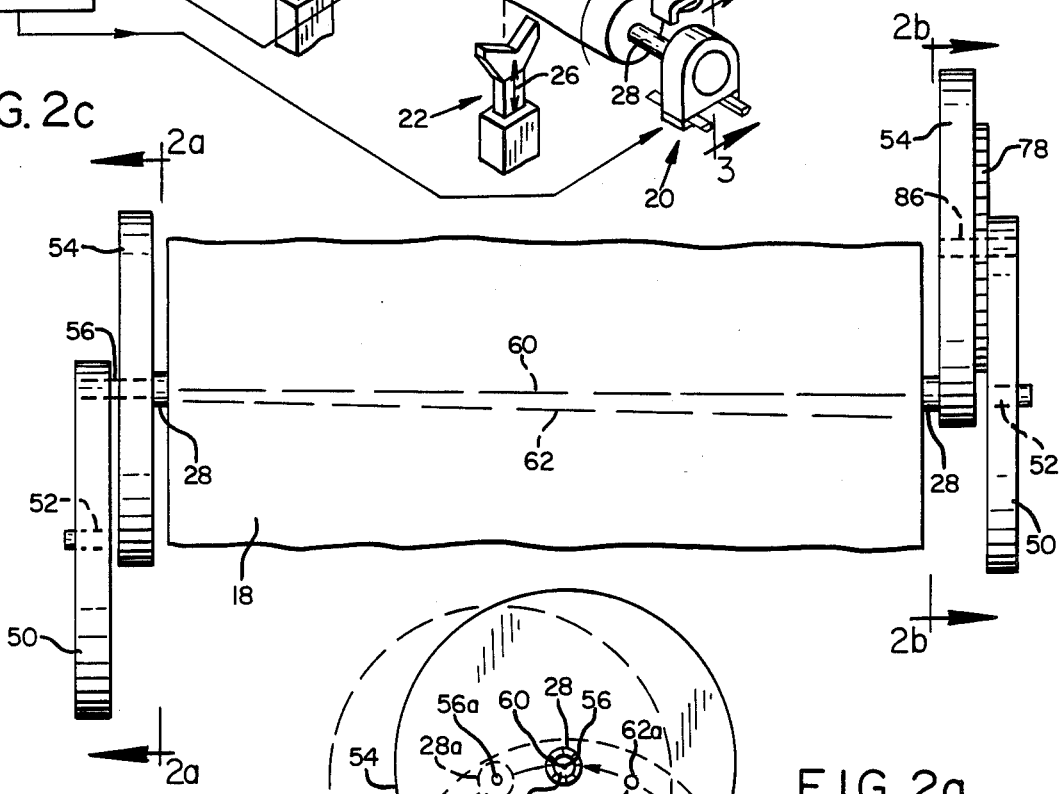
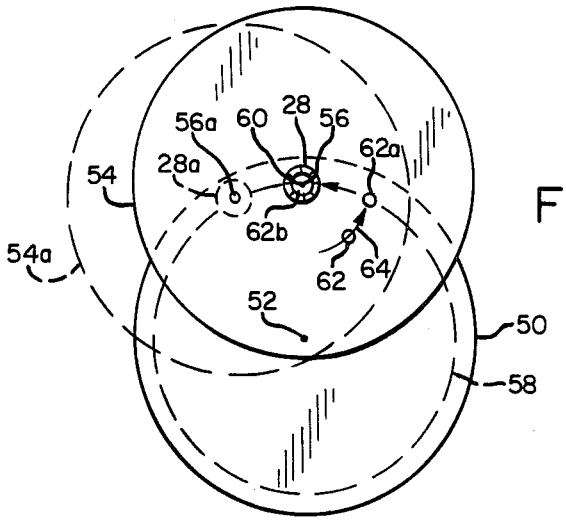
FIG. 2a

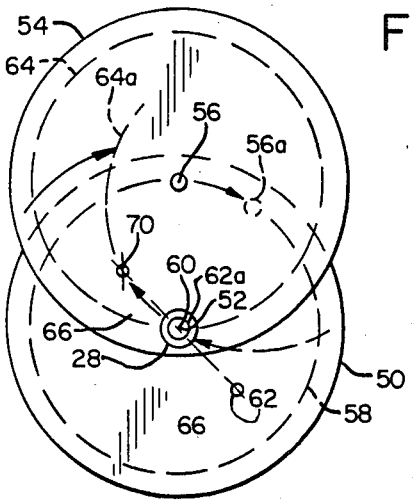
FIG. 2b
FIG. 2d
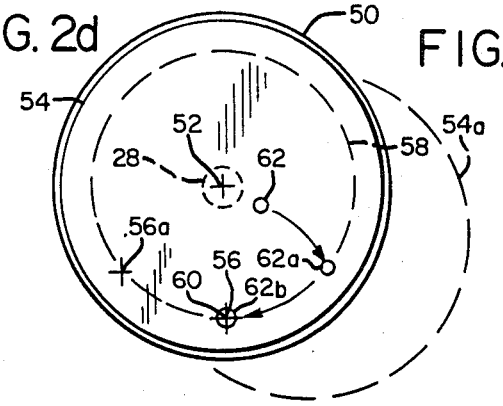
FIG. 2e
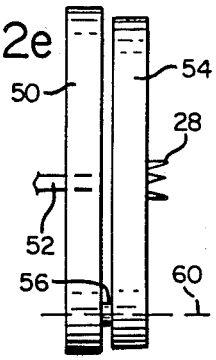
FIG. 3
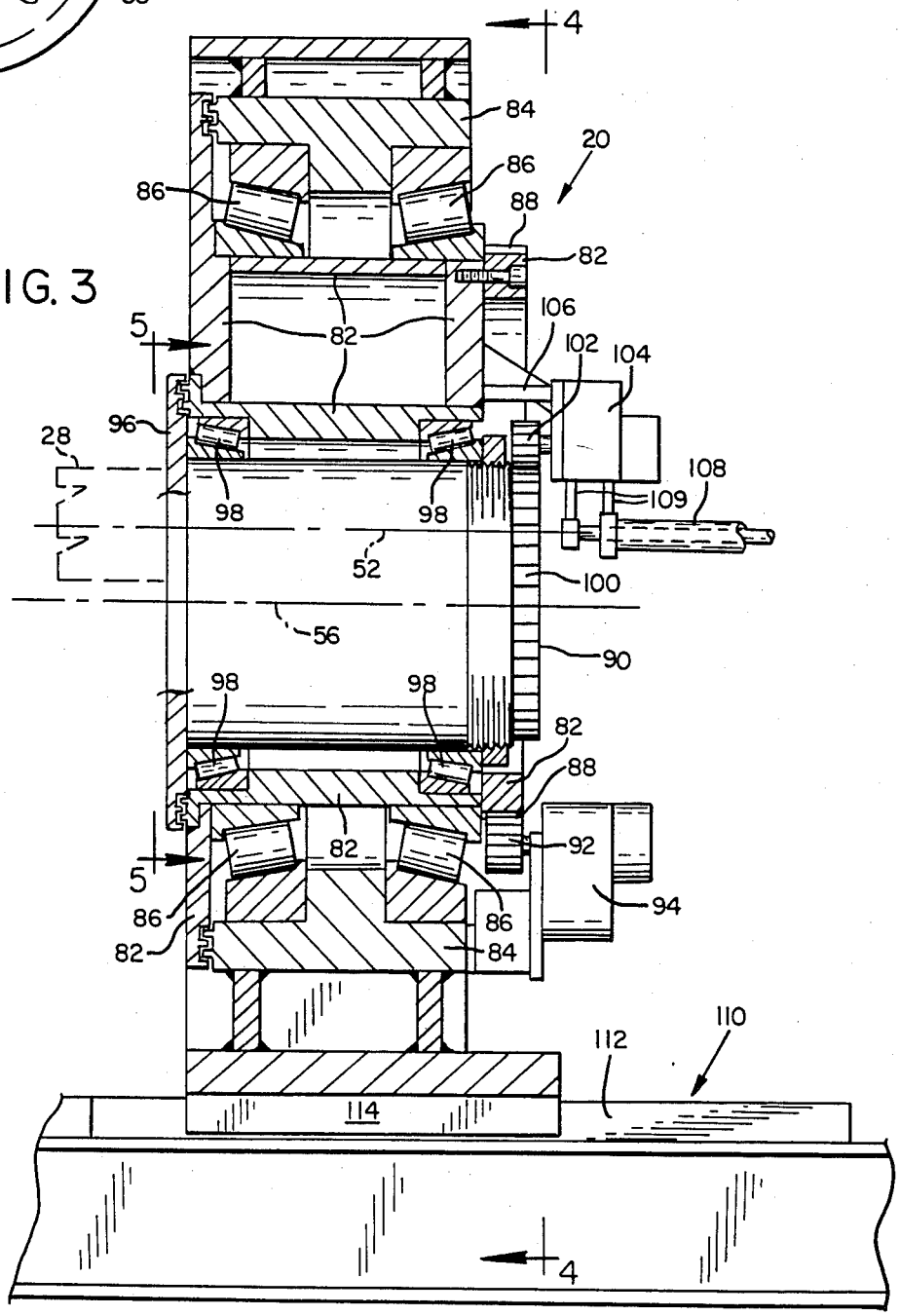

APPARATUS AND METHOD FOR CENTERING LOGS

FIELD OF INVENTION

This invention relates to a log centering apparatus and more particularly to a mechanism including spindles which grip and rotate a log to enable measurement, and then reposition the log in response to an analysis of the measurement data.

BACKGROUND OF THE INVENTION

Veneer for plywood is produced by mounting a log between lathe spindles that turn the log while a lathe blade is controllably moved into the log. A continuous ribbon of thin veneer, e.g. one-tenth of an inch thick, is peeled from the log until the log is reduced to a core diameter too small for peeling.

It is well-known that the log needs to be properly centered in the lathe spindles for optimizing the available veneer in the log. Typically, a centering apparatus is provided at a position spaced from the lathe. The log is centered in the centering apparatus while a previously centered log is being peeled. A transfer device then transfers the log from the centering apparatus to the lathe. This combination of apparatus and method of centering logs, in general, is disclosed in the prior U.S. Pat. No. 4,246,940 issued Jan. 27, 1981.

In such prior apparatus, the centering apparatus typically also involves a geometric centering device, e.g. centering V's that roughly center the log. The log is then gripped by end-pinning spindles similar to but different than the lathe spindles. These end gripping spindles are hereafter referred to as centering or scanning spindles. The centering or scanning spindles rotate the log past stationary scanners. The scanners measure the log at spaced cross sections and convey the measurements to a computer. The computer determines the desired axis of rotation for peeling that log and directs the scanning spindles to adjust the log position so that the desired axis coincides with a replicate axis. The replicate axis is an axis that replicates the lathe axis at a fixed and known position in front of the lathe. The transfer device transports the postitioned log to the lathe spindles so that the prior position of the replicate axis through the log, i.e. the log's desired axis, becomes the turning axis in the lathe spindles.

The present invention is directed to the mechanism that controls the scanning spindles that grip the log, rotates it for scanning, and then adjusts the position of the log in response to computer instructions. The concept of adjustable spindles in general is not new, but the manner by which the apparatus of the present invention accomplishes the adjustment is believed novel and is furthermore believed to be less expensive in construction, has fewer moving parts, and thus less maintenance, and is more accurate and thus more reliable.

BRIEF DESCRIPTION OF THE INVENTION

The basic concept of this invention is to provide coupled pivots for positioning each log end. A primary disk or arm is rotated about a fixed pivot, and a secondary disk or arm is rotated about a movable pivot on the primary disk, i.e. spaced from the fixed pivot. Rotation of the primary disk about the fixed pivot defines a circular path of movement of the second pivot around the fixed pivot. The secondary disk is rotated about the second or movable pivot and carries a log end pinning spindle (or in one version, the spindle is directly connected to the primary disk at the point of the second pivot). As will be hereafter appreciated, it is the ability to generate cooperative coupled rotative movement of the log end about the two pivots that provides the basis for this invention. It is believed that describing and illustrating the pivoting members as disks will facilitate ease of understanding but the reader needs to appreciate that arm members may suffice as well.

In the preferred embodiment, the rotating disks are incorporated into log end grippers. Adjustable scanning spindles of the log end grippers rotate the log for scanning and then reposition the log for peeling about a desired axis. The scanning spindle of one of the log end grippers is a drive spindle for rotating the log, and the spindle of the opposite log end gripper is an idler spindle.

Both log end grippers include a primary disk having a center axis of rotation that is fixed, and a secondary disk having a center axis of rotation positioned on the primary disk but spaced from the fixed axis of rotation. Rotation of the primary disk sweeps the axis of the secondary disk in a primary circular path about the fixed axis. The axis of the secondary disk is referred to as a secondary or movable axis of rotation.

For the log end gripper having the drive spindle (hereafter drive end gripper), the drive spindle is fixedly mounted to the center of the secondary disk with the spindle axis coinciding with the movable axis. The fixed replicate axis passing through the log end gripper, passes through a point on the circular path of the movable axis. In the scan position, the drive spindle and movable axis is positioned (by rotation of the primary disk) to coincide with the replicate axis.

For the log end gripper having the idler spindle (hereafter idler end gripper), the secondary disk is positioned so that an edge portion overlaps the fixed axis of rotation. The idler spindle is mounted to the secondary disk at a position on the outer edge portion that enables positioning of the spindle axis (about which the idler spindle freely rotates) to coincide with the fixed axis of the primary disk. Movement of the idler spindle about the movable axis of the secondary disk defines a secondary circular path. This secondary circular path of the idler spindle is swept around the fixed axis, but always with the fixed axis located on the path. The replicate axis passes through the fixed axis and thus also on the path generated by the spindle. In the scan position, the idler spindle axis is positioned to coincide with the replicate axis.

In operation, the log is first geometrically centered in centering V's to establish a geometric axis through the log. The scanning spindles are pinned at the geometric axis. The ultimate desired axis of rotation is presumed to be in a region of proximity surrounding the geometric axis. Establishing the replicate axis at the spindle axis thus generally minimizes the distance of adjustment necessary for placing a desired axis on the replicate axis. Thus the log is rotated by the spindles, around the log's geometric axis and thus also around the replicate axis. Following the scanning step, a computer determines a desired axis and the objective is to reposition the log through movement of the spindles to align the desired axis with the replicate axis.

The desired axis is represented on the drive end gripper as a point on the secondary disk. (The spindle is fixed to the secondary disk and thus the log end and the desired axis through the log end is fixed relative to the secondary disk.) The secondary disk, and thus the log end and desired axis, is rotated to place the point of the desired axis on the circular path defined by the movable axis. The primary disk is then rotated to move the point along the circular path to the point of the replicate axis.

The desired axis is represented on the idler end gripper as a point having a distance and direction from the replicate axis (on which the spindle is centered during scanning). The direction is determined in consideration of the log position after repositioning by the drive end gripper. Following such repositioning at the drive end, the log and the idler spindle is prevented from further turning about the spindle axis. Thus, moving the free turning spindle axis at the idler end to a determined position in the direction opposite to and at the same distance as the desired axis is from the replicate axis, will place the desired axis precisely on the replicate axis. This placement of the spindle axis at the determined position is accomplished by rotating the primary disk until the secondary circular path (on which the spindle is located), is located on this determined position. The secondary disk is then rotated to move the spindle along the path to that position and thus locates the desired axis at the replicate axis.

The invention will be more clearly understood upon reference to the following detailed description and accompanying drawings.

BRIEF DESCRIPTION OF THE DRAWINGS

FIG. 1 is a diagrammatic illustration of a log peeling operation including a log centering apparatus in accordance with the present invention;

Figure 4:
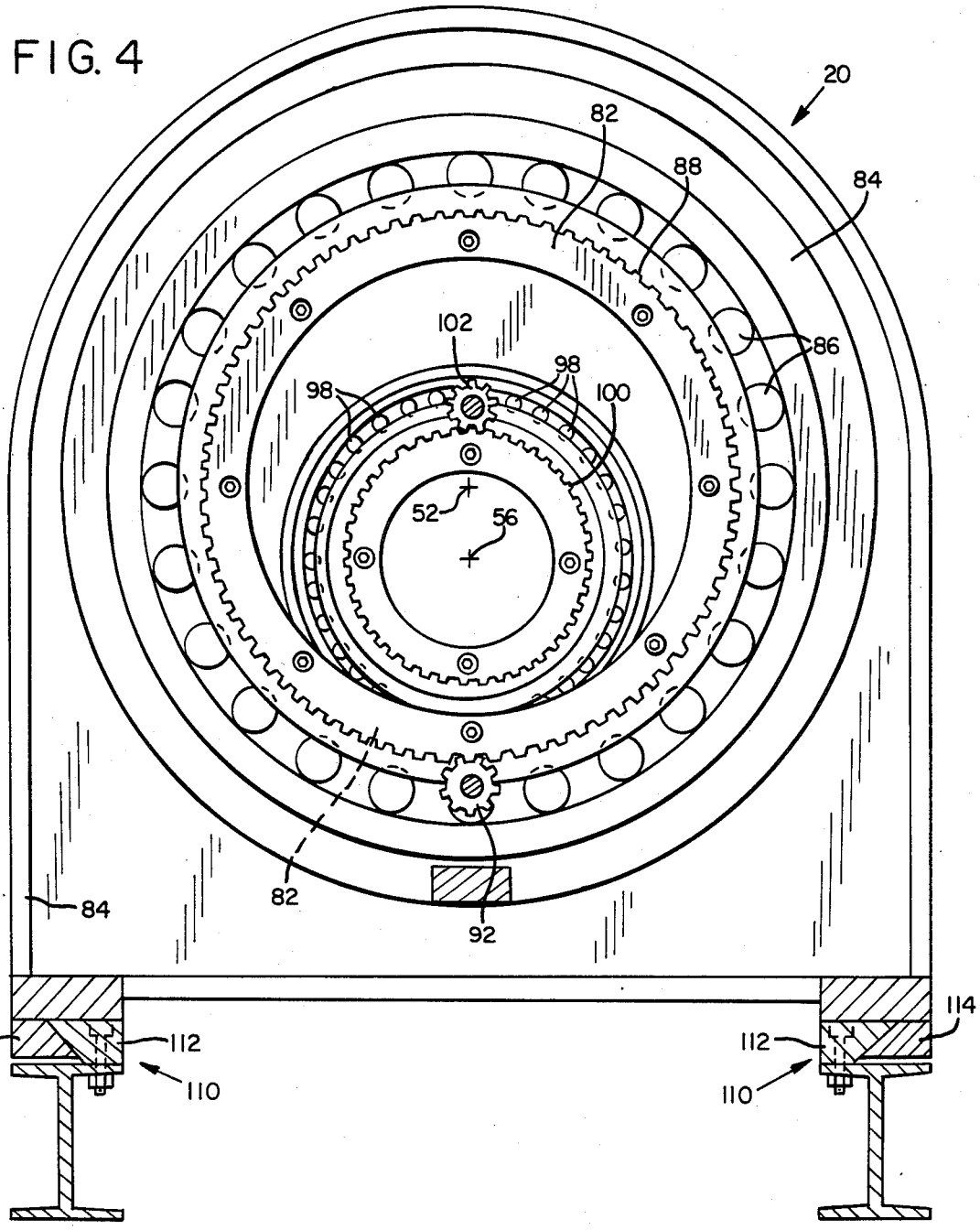
Figure 5A:
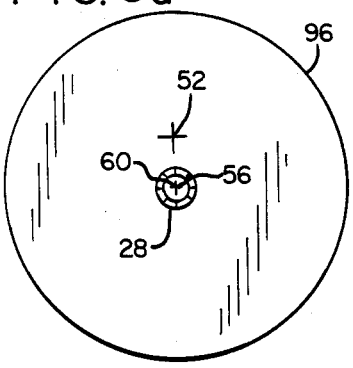
Figure 5B:
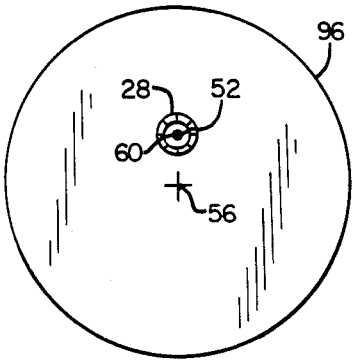
Figure 5C:
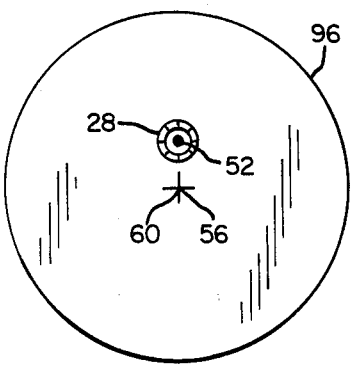
Figure 6:
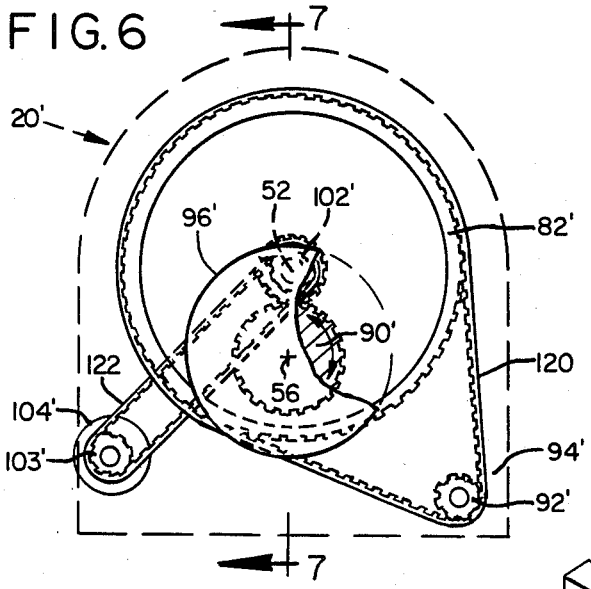
Figure 7:
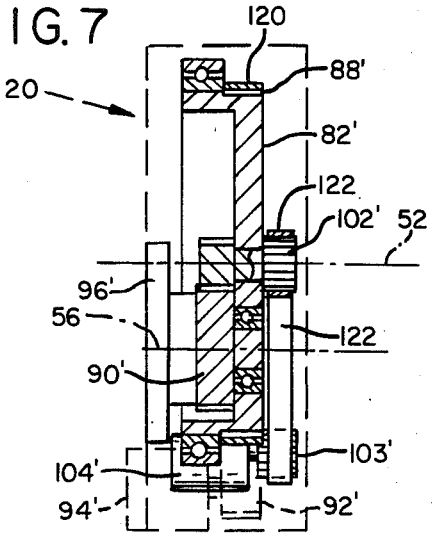
Figure 8:
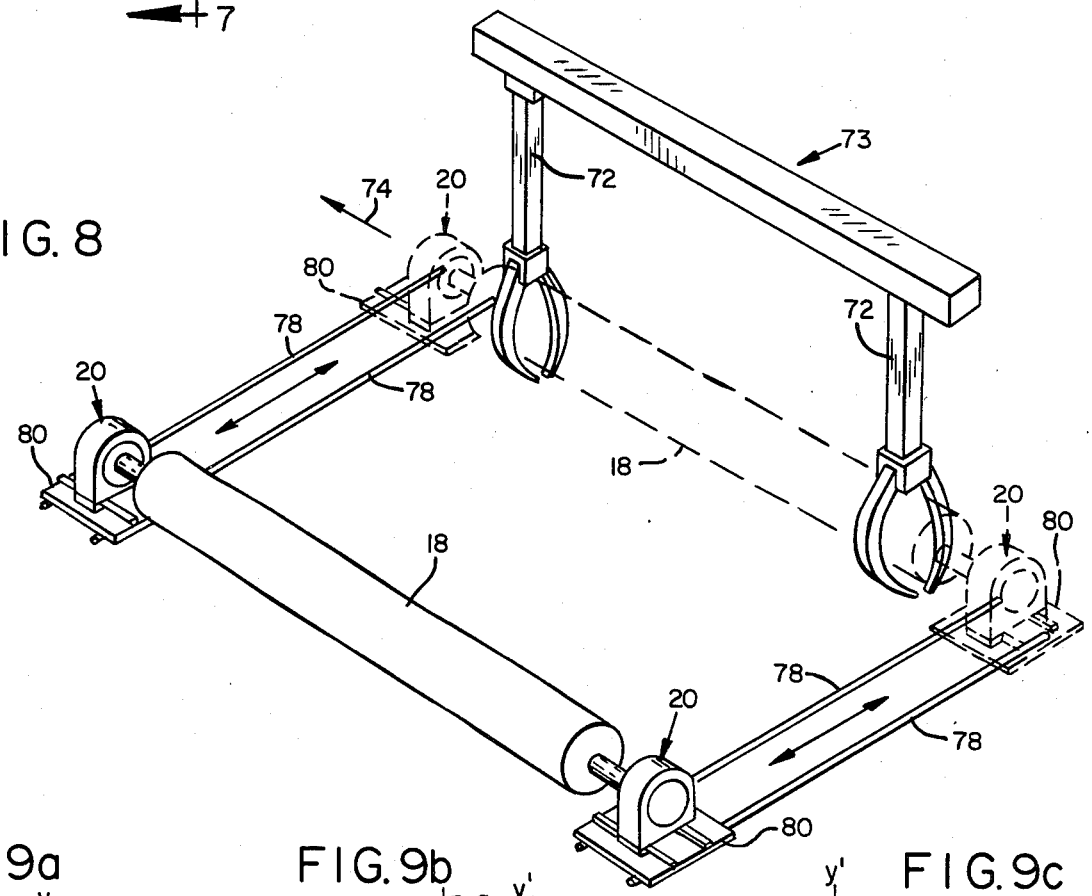

FIGS. *2a–2e* are a series of sketches, diagrammatically illustrating several versions of the concept of repositioning a log in the apparatus of FIG. 1;

FIG. 3 is a section view through a log end gripper as if taken on view lines 3—3 of FIG. 1 but illustrating the components in greater detail;

FIG. 4 is a section view of a log end gripper as illustrated by view line 4—4 of FIG. 3 but illustrating more generally the interrelationship of the components;

FIGS. *5a–5c* are various arrangements of the spindle and axes on the face plate as viewed on view lines 5—5 of FIG. 3;

FIG. 6 is a schematic view of an alternate means for driving the log centering mechanism of the end grippers;

FIG. 7 is a view as taken on view lines 7—7 of FIG. 6;

FIG. 8 illustrates an alternate application for the end grippers of FIG. 1; and FIGS. *9a*, *9b* and *9c* demonstrate the operational concept applied to the apparatus of FIG. 8.

Referring to FIG. 1 of the drawings, a log 10 is illustrated in dash lines being rotated between lathe spindles 12. The peeling blade is not illustrated but the reader will understand that a thin sheet 14 is peeled or stripped from the log as indicated by arrow 16.

During the peeling of log 10, a succeeding log 18 is being centered in the centering apparatus of the invention. As illustrated, log 18 is pinned between end grippers 20 of the centering apparatus which will be described in more detail later.

Prior to the centering operation, the log 18 was precentered by a geometric centering device including the lower V's 22 and upper V's 24. The lower and upper V's 22,24 move in sync toward and away from each other as indicated by arrows 26. In operation, a log is first positioned in the lower V's 22 and then the V's are moved toward each other until the upper V's 24 close on the log. In this position, the log is roughly geometrically centered with the spindles 28 of the log end grippers 20. The end grippers grip the log ends and the centering V's are opened to the position of FIG. 1, ready for the next log.

A transfer device includes log clamping arms 30 that travel along a crossbar 32 as indicated by arrows 34. The arms 30 selectively grip and release a log held between gripping lugs 36 on the ends of the arms 30. A crossbar 32 is adapted to travel along guide bars 38 as indicated by arrow 40.

In operation, when the centering operation is completed, the controlled movement of the crossbar 32 along guide bars 38 in combination with the movement of arms 30 on crossbar 32, enables an operator to precisely engage the log ends of a log 18 held in the end grippers 20 and transfer the log across the distance to the lathe spindles 12.

The above operation is common to the industry and the apparatus, other than the centering apparatus, need not be described in further detail. Furthermore, other types of log transfer apparatus are readily adaptable to this invention, a well-known type being referred to as a pendulum charging device. No explanation of this or other transfer apparatus is deemed necessary, and to the contrary would simply add complexity and confusion. The apparatus and method of the centering apparatus will now be described.

As previously explained, the function of the paired log end grippers 20 are two-fold. First the grippers 20 pin the ends with their spindles 28, such pinning occurring at an axis roughly through the geometric center, as determined by the geometric centering device; and the spindles are rotated to rotate the log about said axis. Such rotation occurs as indicated by arrows 42 to rotate the log under a series of spaced optical scanners 44. The scanners project a laser light beam 46 on the log's surface and through its reflection, determines the precise distance to the log's surface at the point of impingement. Any number of scanning techniques are available for this purpose and they need not be restricted to electro-optical scanners. Mechanical as well as acoustical scanning devices are available. An example of optical scanning is illustrated in U.S. Pat. No. 4,246,940.

The scanner readings are taken at angular increments, e.g. every 15 degrees of rotation, and the readings are conveyed to a computer 47 as indicated by arrows 48. The computer organizes the readings to determine the log's configuration and then computes a desired axis of rotation.

The transfer mechanism (30,32,36,38) is programmed to precisely move a log from the centering apparatus to the lathe spindles 12 so that a replicate axis fixedly positioned through the log becomes the axis of rotation in the lathe spindles. Thus when the desired axis of rotation is determined by the computer, the log end grippers are ready to perform their secondary function, which is shifting the log so that the desired axis is positioned to coincide with the replicate axis. This involves adjustment of the position of the log gripping spindles 28 which will now be explained.

The concept for performing the adjustment of spindles 28 is believed unique. An understanding of this concept will be helpful to an understanding of the mechanism making up the log end grippers 20.

FIG. 2*a* represents the drive end gripper 20 as viewed from view lines 2*a*—2*a* in FIG. 2*c*. Reference, however, is specifically made to FIG. 2*a*. A primary disk 50 has a primary axis of rotation 52 that is fixed. A secondary disk 54 is pivotally mounted at its center point 56 to the primary disk 50. Note that rotating disk 50 causes a sweeping rotative movement of disk 54, i.e. with center point 56 defining a path 58 around the fixed axis 52.

Again from FIG. 2*a*, the drive spindle 28 is fixedly mounted to disk 54 with the axis of spindle 28 coinciding with the center point 56 of disk 54, said center point 56 being the axis of rotation for disk 54. The replicate axis 60 is projected through a point on the path 58 and, in the scan position, the disk 50 is rotated to position center point 56 and the spindle 28 at the replicate axis 60. This initial scan position is the position illustrated in FIG. 2*a*. The replicate axis will hereafter be designated by reference number 60. Obviously rotation of disk 50 will change the position of center point 56 and spindle 28, but replicate axis 60 is fixed and will always remain in this initial position.

With the scan spindle 28 and the replicate axis 60 as shown, the disk 50 is held fixed while disk 54 is rotated for scanning. The computer determines the desired axis through the log. Because the log is fixed to spindle 28, the desired axis can be represented on disk 54 as a point 62 (a small circle being illustrated to differentiate the desired axis from the various axis of rotation). It is now necessary to position the desired axis or point 62 of disk 54 at the position of the replicate axis 60. Primary disk 54 is rotated, again about center point 56, to place point 62 on the circular path 58. This movement of point 62 is indicated by arrow 64 and the modified position of point 62 is indicated as point **62*a* on path 58. The disk 54 is then fixed so that point 62*a* remains on path 58 and disk 50 is rotated to move point 62*a* along the path 58 toward the replicate axis 60. This rotative movement sweeps the entire disk 54 as indicated by dash line 54*a* and accordingly moves spindle 28 and center point 56 to a new position on path 58 as indicated by reference numbers 28*a* and 56*a* respectively. Rotation of disk 50 stops when point 62*a* is positioned over replicate axis 60, the further modified position of point 62 indicated by reference 62*b*. This exact same two-step rotation of the disk 50 and 54 will locate any position on the disk 54 (and accordingly any position on the log end) at the replicate axis 60**.

Reference is now made to FIG. 2*b* representing the idler end gripper (view lines 2*b*—2*b* of FIG. 2*c*). The same concept cannot be used for the gripper with the free rotating spindle because once the log's rotative position is determined for one end (FIG. 2*a*), that rotative position is fixed. The log end can be shifted but it cannot be rotated or turned.

In FIG. 2*b*, a primary disk 50 is again mounted for rotation about a fixed axis of rotation 52 and a secondary disk 54 is mounted on disk 50 for rotation about its center point 56. The major difference is that the free spindle 28 is rotatably mounted with its axis near the outer edge of disk 54 at a point that can be rotated to a position exactly over axis 52. The replicate axis 60 passes through axis 62. Thus spindle 28 is at the scan position as illustrated in FIG. 2*b*.

In order to understand the repositioning concept for the idler end gripper (FIG. 2*b*), it must be noted that rotating spindle 28 about axis 56 of disk 54 generates the circular path 64. The path 64 can be shifted in a sweeping path around axis 52 by reason of axis 56 being movable on its path 58.

It must further be appreciated that any point on the log end (geometrically centered on spindle 28) will retain its exact same relative angular position and, of course, the same distance to any other point on the log end. In concept, the desired axis 62 is determined as a point 62 relative to the axis spindle 28 which, prior to repositioning, is also the replicate axis 60. Thus, if spindle 28 is moved away from replicate axis 60 the exact distance and direction that replicate axis 60 is initially positioned relative to point 62, i.e. positioning spindle 28 at point 70, then point 62 will be positioned at the replicate axis 60.

This positioning is accomplished by first determining point 78. Note the centerline 66 drawn through points 62 and 60 and extended to point 70, equidistant front point 60. Then disk 50 is rotated about axis 52 to shift path 64 of disk 54 to a position **64*a* where it passes through point 70, thus shifting point 56 to its new location 56*a* on path 58. At this position, both spindle 28 and point 70 are on path 64*a*. Disk 50 is then held fixed and disk 54 rotated about its axis 56*a* to reposition spindle 28 onto point 70. This positions point 62 onto replicate axis 60 as indicated at 62*a***.

FIG. 2*c* illustrates, schematically, the two end grippers of FIGS. 2*a* and 2*b*. Several alternatives are available, however. In FIG. 2*a*, disk 54 can be simply the spindle 28 having controlled rotation about axis 56. In another alternate form, both ends 2*a* and 2*b* can be structured like that of FIG. 2*b* provided that spindle 28 has the additional control of being rotatable for scanning and following scanning being non-rotatable, i.e. regardless of its position around path 64, the spindle would retain its same orientation (non-rotatable, non-turning) so that the log would not be rotated in the process of rotating the disks around either of axis 52 or axis 56. This occurs without the added control in the preferred embodiment of FIG. 2*b* because spindle 28 of FIG. 2*a*, once repositioned, prevents the log from rotating. If both ends are to use the positioning concept of FIG. 2*b*, then the spindle at each end must be controlled so as to prevent rotation of the log.

FIGS. 2*d* and 2*e* represent a further alternative to the concept. This is differentiated principally due to the location of the replicate axis 60 at a point spaced from the scanning axis 52. A log is positioned by spindle 28 for rotation about axis 52 of disk 50. After scanning, a desired axis 62 is determined. Disk 54 is rotated about its axis 56 to position point 62 on the circular path 58, the path of axis 56 about axis 52. This places disk 54 in the dash position of **54*a* and point 62 at point 62*a*. Replicate axis 60 is at a fixed position on path 58. Rotating the disk 54*a* around axis 52 enables the location of point 62*a* at the replicate axis 60. This, of course, shifts axis 56 to position 56*a***.

The above assumes that spindle 28 is fixed. If spindle 28 is free as required for the other side where rotation of the log is prohibited, the same concept as described is used but modified to control positioning of the spindle 28 so that it is positioned relative to replicate axis 60, exactly coinciding with the distance and direction of spindle 28 to point 62 (like the positioning described for FIG. 2*b*).

A preferred embodiment of the apparatus for the concepts illustrated in FIGS. 2*a*–2*e* will now be described.

It will be appreciated that all the described embodiments are dependent on establishing two axes of rotation, one of the axes is fixed and the other is movable in a fixed circular path about the fixed axis. Means are provided to control the positioning of the movable axis on the circular path. A log-end-holding spindle is mounted relative to the movable axis. The differences between the two ends and as between the different concepts resides in the positioning of the spindle and whether the spindle is fixed, free turning, or rotatably controlled. The basic structure without the spindle and its position will be first described.

Referring to FIGS. 3 and 4, reference number 84 refers to a housing for the gears that produce the desired controls for the log end spindles. A ring gear 82 (corresponding to disk 50) is shown rotatably mounted on roller bearings 86 within the housing 84. Ring gear 82 is used here to indicate all those components that are secured to the ring gear portion having gear teeth 88 and rotatably driven around axis 52 by drive gear 92, in turn driven by motor 94.

A wheel gear 90 (corresponding to disk 54) is mounted inside ring gear 82 on roller bearings 98. Again, the wheel gear 90 is intended to encompass all those components that are fixed to the portion having gear teeth 100, rotatably driven by drive gear 102, in turn driven by motor 104. Wheel gear 90 is driven about movable axis 56 and includes a face plate or disk 96 that for all intents and purposes is the disk 54 of FIGS. *2a–2e*. In the arrangement of FIGS. 3 and 4, motor 104 is necessarily mounted to the ring gear 82, e.g. by shaft 106. Motor 104 is a hydraulically driven motor provided with hydraulic fluid through line 108. Line 108 is on the fixed axis 52 and does not move. The interconnecting lines 109 are mounted on a rotating collar in accordance with existing technology. However, electrical wires to the motor (not shown) are subject to twisting, which is of some concern. Such twisting can, however, be kept to a minimum, and in the worst condition does not exceed a 360 degree turn. Technology is available to provide for such twisting and need not be further explained.

It will be appreciated that the log must be repeatedly gripped and released by the spindles 28. The spindles may be provided on a movable shaft, or, as contemplated for the preferred embodiment, such movement is provided by moving the entire housing 84 toward and away from the log as provided by a slide mechanism 110 shown as a pair of rails 112 on which pads 114 of the housing are guided. The driving mechanism for driving the housing along rails 112 is not shown but are well-known to the industry.

It will be appreciated that gripping and releasing of the logs by spindle 28 generates the major need for maintenance and repair to the spindle and face plate 96. An advantage of the apparatus illustrated in that the face plate can be simply bolted onto wheel gear 90 to be readily removed for repair or replacement.

Reference is now made to FIGS. *5a* through *5c* showing the face plate 96 as indicated by view lines 5—5 of FIG. 3. FIG. *5a* illustrates the face plate 96 (54) for the log end grippers 20 of FIG. *2a*. The spindle 28 is fixed to the face plate with the spindle axis coinciding with the axis 56. It is shown in the scanning position with the spindle 28 centered on replicate axis 60. (FIG. *2a* and FIG. *5a* show the relationship of axes 52 and 56 reversed, which, of course, is simply a matter of design choice.)

FIG. *5b* illustrates the face plate 96 (54) for the log end gripper 20 of FIG. *2b*. The spindle 28 is rotatable around a center axis which, as illustrated in FIG. *5b*, is centered on axis 52 and replicate axis 60 (again, axes 52 and 56 being reversed from what is shown in FIG. *2b*).

FIG. *5c* illustrates the condition of FIGS. *2d* and *2e*. The spindle 28 is mounted to the face plate 96 with the spindle 28 adapted to be centered over axis 52 for scanning. The replicate axis 60 is located on the path 58 and, in FIG. *5c*, axis 56 which defines path 58 is positioned on the replicate axis 60.

The embodiment of FIGS. 3 and 4 require accommodation for the motor 104 which is mounted to the ring gear, e.g. the electrical wires leading to motor 104 will twist during rotation of the ring gear 82. Such accommodation is well within the available technology. However, alternate means for driving the gears are available to avoid this problem. Note from the schematic illustration of log end gripper 20' shown in FIGS. 6 and 7 that the gear 102' for driving wheel gear 90' which in turn drives plate 96' can be journaled on the axis 52 of the ring gear 82' by establishing the proper size relationship between ring gear 82' and wheel gear 90'. Because now the axis of drive gear 102' is fixed in space, the motor for driving gear 102' can have a fixed relationship to that axis and can be mounted directly to the housing. Motor 104' could be mounted directly behind gear 102' (as in FIG. 3) but a further modification is illustrated by the provision of an interlinking driven timing belt 122. As shown, motor 104' is conveniently mounted on the housing and its output shaft 103' is connected through timing belt 122 to the drive gear 102. In either event, this arrangement avoids the special accommodations for the electrical wires and the hydraulic fluid line 109.

In this alternative embodiment of FIGS. 6 and 7, motor 94' is also conveniently mounted on the housing with drive gear 92' connected to gear teeth 88' of ring gear 90' by timing belt 120. The timing belts 120 and 122 provide convenience in design and maintenance. Accessibility for lubrication is but one of the benefits.

With the illustrations and descriptions provided above, those skilled in the art will be capable of producing the apparatus of the invention. Computer controls and mechanism for accomplishing the various functions are well-known to the industry and can be applied upon appreciation of the inventive concept. That concept involves the determination of a circular path as the distance of a replicate axis spaced from an axis of rotation. A log is rotatable about two axes, one being the axis of rotation for the circular path and a second axias that provides for a sweeping movement of the center region of the log across the circular path. A selected axis in the center region can thus be positioned relative to the replicate axis as desired, by a combination of controlled pivoting of the log about the two axes.

Also, the invention is not limited to centering logs in a veneer lathe operation. It is considered applicable, for example, to lumber processing. Referring to the partial system shown in FIG. 8, which is a modification of the FIG. 1 system, the log end grippers are considered particularly adaptable to being mounted on supports 80 for parallel movement on ways 78 for transferring the log in a charging capacity. Thus, if the lathe spindles 12 of FIG. 1 are replaced with side-gripping dogs 72 of a log carriage 73 as shown in FIG. 8, the log can be transferred to the side-gripping dogs 72 directly from the log end grippers. The log is delivered after scanning and after the desired alignments have been computed. The transfer is thus accomplished following appropriate positioning of the log by the end grippers 20, i.e. the log is appropriately positioned for lumber cutting when engaged by the dogs 72.

A very significant advantage is derived from this variation of applying the rotatable and adjustable scanning spindles to lumber processing. A log is typically analyzed for lumber production from a single angular orientation. Thus the log as it is delivered into the system, typically has fixed X and Y axes. An assumption is made that the saws will cut through a log parallel to its fixed Y axis. The log is thoroughly analyzed and the best pattern of lumber for the log at that angular orientation is determined.

Figure 9A:
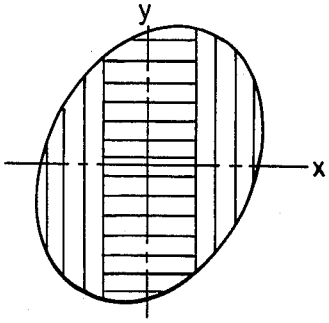
Figure 9B:
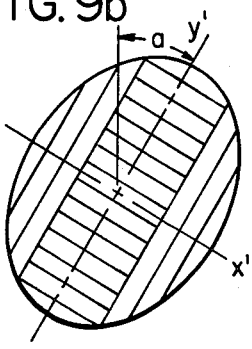
Figure 9C:
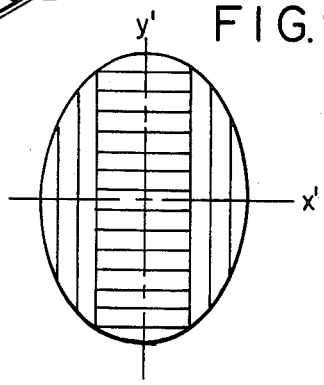

However, the angular orientation that is utilized is arbitrary or simply selected by change and a better solution will likely occur at a different angular orientation. Compare FIGS. 9*a* and 9*b*. The log of FIGS. 9*a* and 9*b* (the same log) has an arbitrarily selected angular orientation. The cutting pattern determined for FIG. 9*a* is a pattern in the traditional X-Y axis as utilized in prior systems. A better solution may be one such as that illustrated in FIG. 9*b*, i.e. at a X'Y' axis offset by angle a. The scanning procedure of FIG. 1 (which, of course, is applicable to FIG. 8) would readily make that determination by taking orthogonal dimensional data at numerous angular positions of the log, e.g. determined through Real Shape TM analysis (the trademark of a computer analysis process developed for lumber processing and marketed by the Applied Theory division of U.S. Natural Resources, Inc., located in Corvallis, Oreg. From this analysis, a specific X'Y' orientation would be determined as the best angular orientation, and then the log would be repositioned by the angle a to align the log relative to the traditional Y axis cutting, i.e. the position of FIG. 9*c*.

The scope of the invention is specifically defined in the claims appended hereto.

We claim:

1. A centering apparatus for log processing comprising;

a pair of log end grippers for log scanning and positioning, each of said log end grippers having a first member rotatable about a fixed axis of rotation and a second member rotatable about a movable axis of rotation on the first member spaced from the fixed axis, a log-end-engaging spindle attached to the second member and being positioned over one of the axes of rotation to be rotated about said axis for scanning and to thereby determine a selected axis through the log, and said spindle end pinning a log at its approximate geometric axis and a region on the log end surrounding the geometric axis designated as a region of adjustment, and a designated axis penetrating said region providing a replicate axis having a position fixed in space and at which the selected axis is to be positioned, and said selected axis within the region of adjustment movable about said fixed and movable axis of rotation of the first and second members, a circular path defined as a path about one of the fixed and movable axes of rotation represented by the distance of replicate axis from the said one axis of rotation whereby pivoting of the spindle and log end held thereby about one of the fixed and movable axes causes sweeping of the designated region of adjustment across the circular path for placement of the selected axis at a known position relative to the circular path, and rotation about the other of the fixed and movable axes places the selected axis at the replicate axis.

2. A centering apparatus as defined in claim 1 wherein the replicate axis is initially positioned on the axis about which the log is rotated for scanning.

3. A centering apparatus as defined in claim 2 wherein the replicate axis is positioned on the fixed axis of rotation and means for maintaining the end pinning spindle of one of the log end grippers in a fixed angular orientation following scanning.

4. A centering apparatus as defined in claim 3 including means for maintaining the end pinning spindles of both of the log end grippers in a fixed angular orientation following scanning.

5. A centering apparatus as defined in claim 3 wherein the end pinning spindle of the other log end gripper is fixed to the second member and the end pinning spindle of the said one log end gripper is free turning about is axis, said fixed spindle of the other log end gripper providing the means for maintaining the fixed angular orientation of the spindle of said one log end gripper.

6. A centering apparatus as defined in claim 1 including a housing, a ring gear as the first rotatable in said housing, a wheel gear as the second member rotatable in the ring gear, a face plate mounted to the wheel gear and a spindle carried by the face plate.

7. A centering apparatus as defined in claim 6 wherein the face plate is removably mounted to the wheel gear for maintenance and replacement.

8. A centering apparatus as defined in claim 7 wherein the log end grippers are mounted for relative movement along the direction of the spindle axis for causing end pinning engagement and release of the spindles with the logs.

9. A method of centering logs in a log processing operation comprising;

mounting a log for rotation about a scanning axis approximating the log's geometric axis, scanning the log to determine a selected axis through the log and determining the position of the selected axis relative to a replicate axis replicating the log processing axis and having a fixed position in space, providing a double axis of rotation at each log end, one axis being fixed and the other being movable in a fixed path about the fixed axis, said replicate axis and said selected axis being in a region of adjustability established by the double axis, and said log mounted for pivoting said both axes, one of said axes providing the axis for scanning, and cooperatively pivoting the log about said fixed and movable axis to position the selected axis through the log at the replicate axis.

10. A method as defined in claim 9 wherein the axis of scanning is located on the replicate axis.

11. A method as defined in claim 10 wherein the replicate axis is spaced from one of said fixed and movable axis of rotation and defines a path around said axis, rotating the log end about the other of the fixed and movable axis of rotation to place the selected axis on said path, and rotating the log about said one of said fixed and movable axes to move the selected axis along the path and onto the replicate axis.

12. A method as defined in claim 10 including mounting the log for rotation about the scanning axis and then fixing the angular orientation of the log at one end for positioning of the selected axis at that end on the replicate axis.

13. A method as defined in claim 12 including fixing the log end relative to the movable axis at the other end for angular repositioning as dictated by movement and rotation of said axis.

14. A method as defined in claim 10 wherein rotation of the log, as provided by end pinning the log, said end pinning provided by the movement of end grippers toward and away from the log along its geometric axis.

* * * * *